US007506905B1

(12) United States Patent
George

(10) Patent No.: US 7,506,905 B1
(45) Date of Patent: Mar. 24, 2009

(54) FIREFIGHTER WEDGE

(76) Inventor: Eric George, 1 Longview Dr., North Haven, CT (US) 06473

( * ) Notice: Subject to any disclaimer, the term of this patent is extended or adjusted under 35 U.S.C. 154(b) by 0 days.

(21) Appl. No.: 11/562,632

(22) Filed: Nov. 22, 2006

(51) Int. Cl.
*E05C 17/54* (2006.01)

(52) U.S. Cl. ..... 292/343; 16/82; 16/86 B

(58) Field of Classification Search ..... 292/342, 292/343, 339; 16/82, 86 A, 86 B
See application file for complete search history.

(56) References Cited

U.S. PATENT DOCUMENTS

D161,200 S * 12/1950 Phelps ..... D8/402
5,340,173 A * 8/1994 Bethel ..... 292/288
6,311,537 B1 * 11/2001 Vigil ..... 72/392
6,616,128 B2 * 9/2003 Selzer ..... 254/104

OTHER PUBLICATIONS

Open Door Industries. Wedge-It door stop. pp. 1-2. (http://www.wedgeit.com/howitworks.htm and http://www.wedgeit.com/specifications.htm) (2000).

* cited by examiner

*Primary Examiner*—Gary Estremsky
(74) *Attorney, Agent, or Firm*—DeLio & Peterson, LLC; Peter W. Peterson

(57) ABSTRACT

A wedge for securing in an open position a hinged door having opposite faces and an edge between the faces. The wedge is luminescent and includes a bottom surface, a top surface at an acute angle to the bottom surface, and a pair of opposite side surfaces extending between the top and bottom surfaces. The wedge further includes an indentation on the bottom and each of the side surfaces sized to fully engage the door edge and make substantial contact with the door edge and the opposite faces. The wedge may be used to identify an entrance or exit to a room during no or low-light emergency conditions by using a UV light source to locate the luminescent wedge and location of the open door.

15 Claims, 5 Drawing Sheets

FIREFIGHTER WEDGE

BACKGROUND OF THE INVENTION

1. Field of the Invention

The present invention relates to a wedge to be employed by firefighters and a method of use of the wedge to hold open doors.

2. Description of Related Art

In fighting fires in a structure, a firefighter must take precautions for his own safety and that of others, but at the same time move as rapidly and efficiently as possible. When entering a structure through a doorway, the firefighter must be able to secure the door in an open position quickly and be confident that it will remain open. A door closing unexpectedly may pinch off the water supply to a fire hose, prevent ventilation of fire gases and smoke, and possibly lock behind the firefighter, trapping him in the building. There is a need for a wedge and method of using the wedge which may quickly, and reliably secure and maintain a door in an open position.

SUMMARY OF THE INVENTION

Bearing in mind the problems and deficiencies of the prior art, it is therefore an object of the present invention to provide a wedge capable of maintaining a door in an open position during a fire or other emergency which is quick, secure, and reliable.

It is another object of the present invention to provide a wedge for maintaining a door on an open position that may be positioned out of the way from a fire hose being dragged along the floor or from being kicked out of place.

A further object of the invention is to provide a wedge which is capable of being seen in low lighting conditions.

It is yet another object of the present invention to provide a wedge for maintaining the door in an open position during a fire or other emergency which may be used in a variety of positions on a door.

Still other objects and advantages of the invention will in part be obvious and will in part be apparent from the specification.

The above and other objects, which will be apparent to those skilled in the art, are achieved in the present invention which is directed to a wedge for securing a hinged door having opposite faces and an edge between the faces comprising a bottom surface, a top surface at an acute angle to the bottom surface, and a pair of opposite side surfaces extending between the top and bottom surfaces. The wedge further includes an indentation on at least one of the bottom or side surfaces sized to fully engage the door edge and make substantial contact with the door edge and the opposite faces.

The wedge bottom surface may have an indentation sized to fully engage the door edge and/or at least one of the wedge side surfaces has an indentation sized to fully engage the door edge. Preferably, the bottom surface and each of the side surfaces have an indentation sized to fully engage the door edge.

When on the bottom surface, the indentation is preferably a rectangular indentation near a tall end of the wedge extending from one side surface to the opposite side surface. When on at least one side surface, the indentation is preferably near a short end of the wedge extending from the top surface to the bottom surface. More preferably, the side surfaces each have an indentation near the short end of the wedge, with the side surface indentation comprising a side support surface parallel with and indented from the side surface, a wide surface perpendicular to the side support surface extending from the side support surface to the side surface, a narrow surface opposite the wide surface perpendicular to the side support surface and extending a distance therefrom, and an angular surface extending from the narrow surface at an angle extending to the side surface. The side support surface, the wide surface, the narrow surface and the angular surface each extend from the top surface to the bottom surface of the wedge.

The wedge is preferably luminescent and has a finger tab on each of the side surfaces near a tall end of the wedge.

In another aspect, the present invention is directed to a method of securing a door having opposite faces and an edge between the faces, the door being hinged to a door frame. The method initially comprises providing a wedge having a bottom surface, a top surface at an acute angle to the bottom surface, a pair of opposite side surfaces extending between the top and bottom surfaces, and an indentation on at least one of the bottom or side surfaces sized to fully engage the door edge and make substantial contact with the door edge and the opposite faces. The method then includes engaging the door edge with the indentation to secure the door in an open position.

The wedge bottom surface may have an indentation sized to fully engage the door edge and make substantial contact with the door edge and the opposite faces, and the method may include contacting the frame with the wedge to secure the door in an open position. The door edge may be a top edge fully engaging the bottom surface indentation. Alternatively, the wedge bottom surface has an indentation which partially engages the door edge to secure the door in an open position, such as with the door bottom edge.

One or both of the side surfaces of the wedge may have an indentation sized to fully engage the door edge and make substantial contact with the door edge and the opposite faces, and the method may include contacting the frame with the wedge to secure the door in an open position. The door edge may be a top edge fully engaging the side surface indentation. Alternatively, the door edge is an inside edge, wherein the side surface indentations partially engage the inside door edge and a door frame edge.

In a further aspect, the present invention provides an emergency kit for identifying an entrance or exit to a room having a door during no or low-light emergency conditions. The kit includes the aforedescribed wedge, with the wedge being UV luminescent, and a UV light source. The UV light source is adapted to locate the luminescent wedge and location of the door to identify an exit or entrance to the room.

In a related aspect, the present invention is directed to a method of identifying an entrance or exit to a room having a door during no or low-light emergency conditions, comprising providing a UV luminescent wedge engageable with the door and a UV light source. The method then includes engaging an edge of the door with the wedge to secure the door in an open position and using the UV light source to locate the luminescent wedge and location of the open door to identify an exit or entrance to the room.

The wedge may include an indentation on surface thereof sized to fully engage an edge of the doors and the method may include fully engaging the door with the wedge to make substantial contact with the door edge and opposite faces of the door to hold the door in the open position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figure 1:
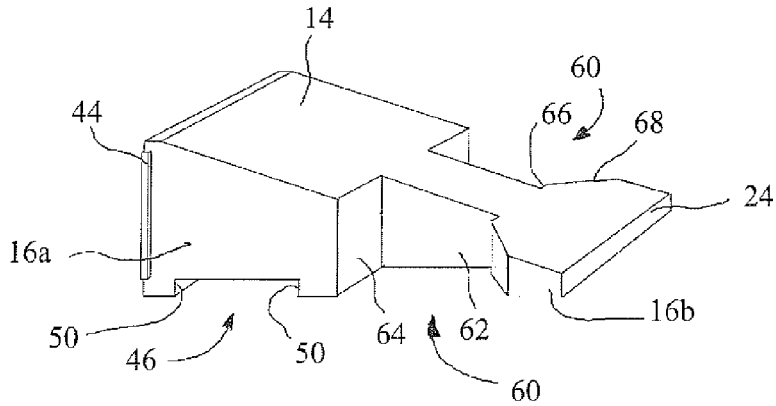
FIG. 1 is a perspective view of the preferred wedge of the present invention.
Figure 2:
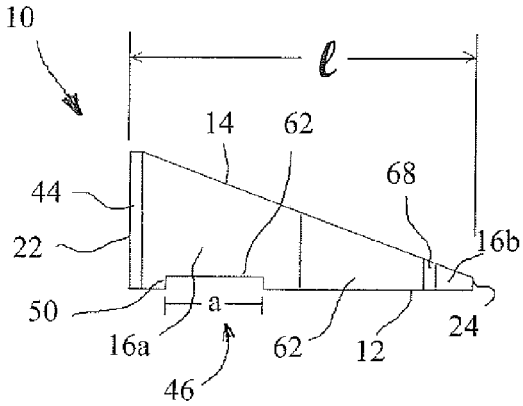
FIG. 2 is a side elevational view of the preferred wedge shown in FIG. 1.
Figure 3:
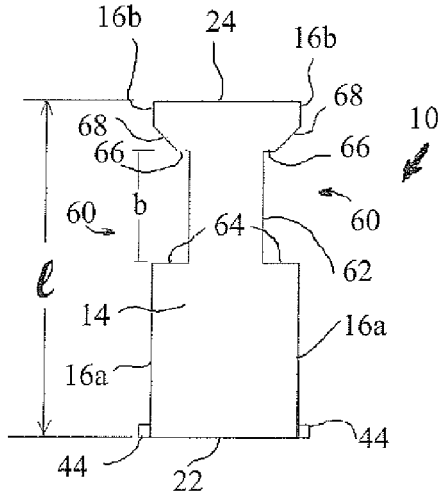
FIG. 3 is a top plan view of the preferred wedge shown in FIG. 1.

FIGS. 1-3 show the preferred embodiment of the firefighter's wedge. The wedge 10 of the present invention is a right angle wedge whereby a bottom surface 12 is substantially perpendicular to a tall end surface 22 at one end of the wedge, and a short end surface 24 at the opposite end of the wedge. An inclined top surface 14 between the tall and short ends forms an acute angle with bottom surface 12 when seen in side view (FIG. 2). If desired, short end surface 24 may be eliminated by extending the top and bottom surfaces until they meet at a sharp edge. Length l is the distance spanning from the tall end 24 to the short end 22 of the wedge. A pair of side surfaces 16*a* and 16*b* extend on opposites sides from top surface 12 to bottom surface 14 along a portion of the length of the wedge. All surfaces of the wedge as shown are substantially flat. Finger tabs 44 extend outward from each of side surfaces 16*a* near tall end surface 22 to permit the user's hand to easily grasp and manipulate the wedge.

The bottom surface 12 of the wedge contains a bottom surface indentation 46, near the tall end 22 of the wedge, extending from one side surface to the opposite side surface. The bottom surface indentation is defined by a bottom support surface 48 parallel with and indented from the bottom surface and opposite lip surfaces 50 perpendicular to the support surface and the bottom surface and extending therebetween. The opposite lip surfaces 50 are spaced apart by a distance a (FIG. 2) equal to a standard thickness of a door so that bottom surface indentation 46 is sized to fit snugly over an edge of a standard door. Preferably, bottom surface indentation 46 is near, or at least closer to, tall end 22 of the wedge. The door edge is said to be fully engaged with the bottom surface indentation when support surface 48 is in substantial contact with the door edge and the opposite lip surfaces 50 are contacting the front and rear faces of the door, respectively, near the edge thereon. The door edge is said to be partially engaged with the bottom surface indentation when the surface of the door edge only contacts a portion of the support surface and the lip surfaces are not fully flush with and contacting the front and rear faces of the door. Preferably the bottom surface indentation opening distance from one lip surface to the opposite lip surface is about 1.25 in. (32 mm), the thickness of a standard door, although other embodiments of the present invention may be sized larger or smaller than this dimension to fit other standard door thicknesses.

Each of the side surfaces 16 of the wedge has a side surface indentation 60 preferably near or at least closer to short end 24 of the wedge, dividing the side surface into a larger side surface portion 16*a* and a smaller side surface portion 16*b*. Each side surface indentation 60 is made up of four surfaces; a side support surface 62 parallel to and indented from the side surfaces 16*a*, 16*b*, a wide surface 64 perpendicular to side surface 16*a* and side support surface 62, and extending from the top surface 14 to the bottom surface 12 vertically and from the side support surface 62 to the corresponding larger side surface portion 16*a* horizontally. Narrow surface 66 is opposite wide surface 64 and is also perpendicular to side support surface 62. Narrow surface 66 extends horizontally from side support surface 62 to an angular surface 68, which extends at a 45° angle when seen in plan view (FIG. 3) to smaller side surface portion 16*b*. Narrow surface 66 and angular surface 68 both extend vertically from top surface 14 to bottom surface 12.

The opening distance b between narrow surface 66 and wide surface 64 (FIG. 3) of the side surface indentation is selected to be equal to the standard thickness of a door, e.g., 1.25 in. (32 mm). Side surface indentations 60 are sized to fit over a door edge of a standard door whereby the door edge is fully engaged with the side surface indentation when the side support surface 62 is sitting flush against the door edge and the wide surface 64 and the narrow surface 66 are contacting the front and rear faces of the door respectively near the edge thereon. The door edge is said to be partially engaged with the side surface indentation 60 when the surface of the door edge only contacts a portion of the side support surface and the wide surface and the narrow surface are not fully flush with and contacting the front and rear face of the door.

Figure 4:
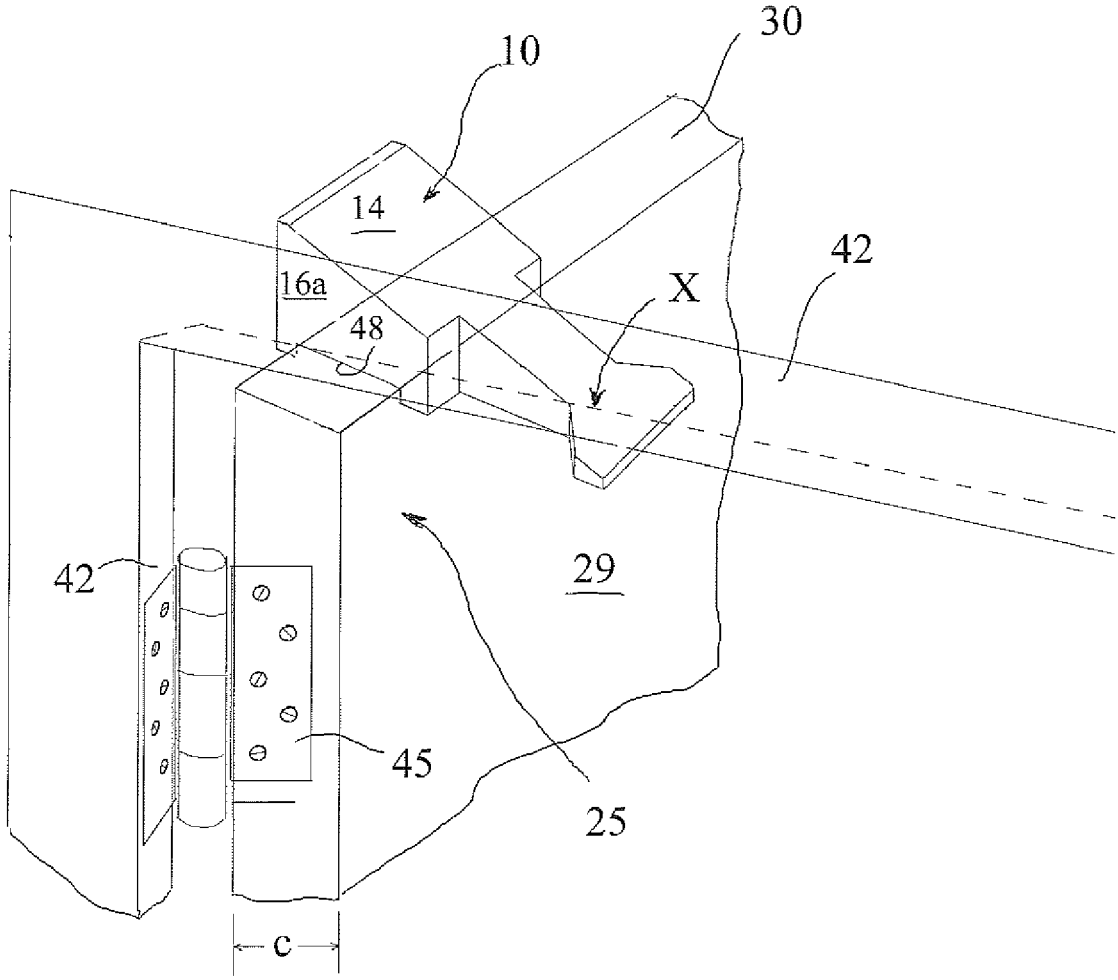
FIG. 4 is a perspective view of a method of using the wedge of the present invention on the top edge of a door to secure it in an open position.

FIGS. 4-8 show preferred methods by which the wedge of the present invention may be used. In FIG. 4, wedge 10 is used to maintain a hinged door 25 in an open position, wherein door 25 is pivotally attached to a door frame 42 by a hinge 45 fastened between the door frame and an inside edge 28 of the door. Door 25 has a front face 29 and a rear face (not shown), and top edge 30 therebetween, and the door thickness c is 1.25 in. (32 mm), equal to the size of the opening of the wedge bottom surface indentation. The wedge of the present invention is utilized by first opening the door to its fully open position, placing the wedge on the top edge 30 of door 25 such that bottom support surface 48 contacts top edge 30 and the bottom surface indentation is fully engaged with top edge 30 near inside edge 28 of the door. As the door is released and closed slightly, top surface 14 of the wedge will contact the top of the door frame 42 at a point X until the force between the wedge and the door frame is sufficient to maintain the door in that opened position. The wedge, in a position off the floor, is less likely to be kicked out or otherwise pulled out of place from a fire hose being dragged into the structure through the doorway.

Figure 5:
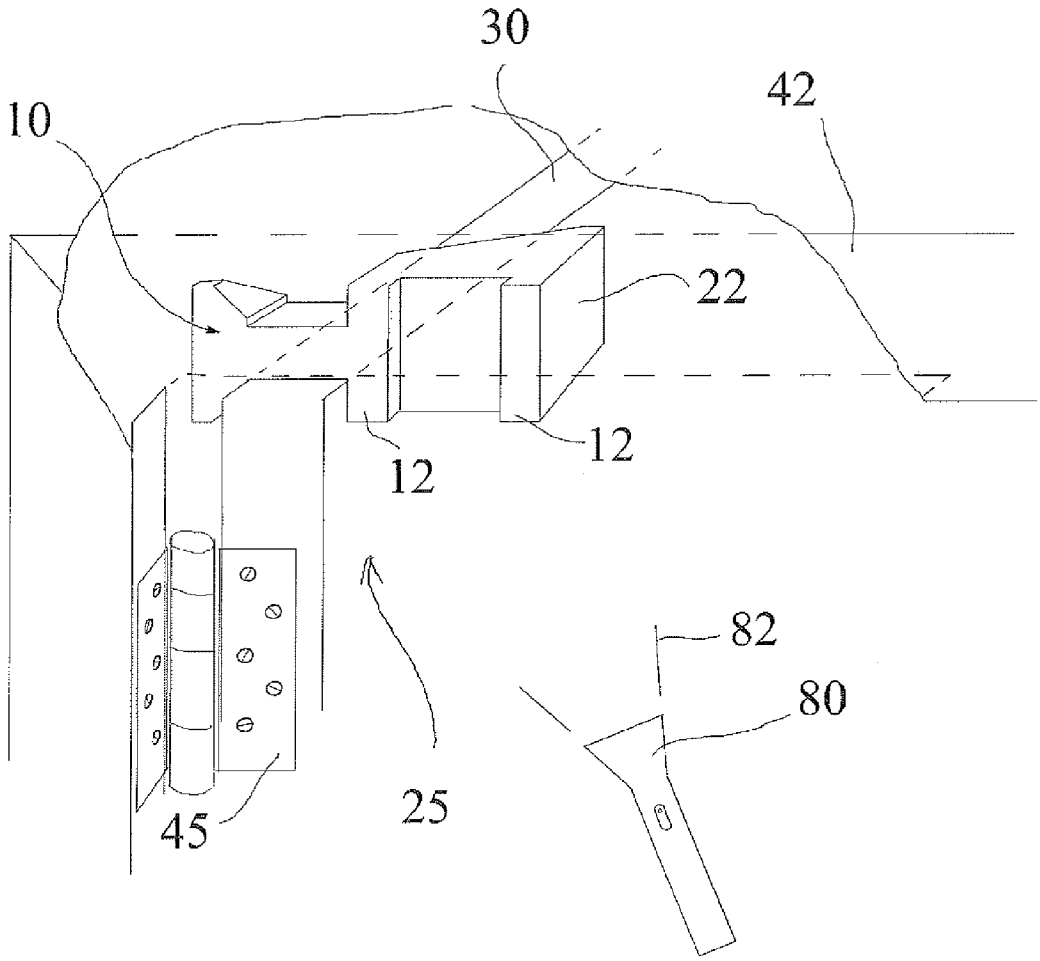
FIG. 5 is a perspective view of another method of using the wedge of the present invention on the top edge of a door to secure it in an open position.

A similar method is shown in FIG. 5, wherein wedge 10 is secured over the same top edge of door 25 as in FIG. 4, except that side surface indentation 60 is fully engaged on the top edge 30 of the door. In this position, preferably at least a substantial portion of bottom surface 12 of the wedge contacts the door frame 42 to maintain the door in an open position.

Figure 6:
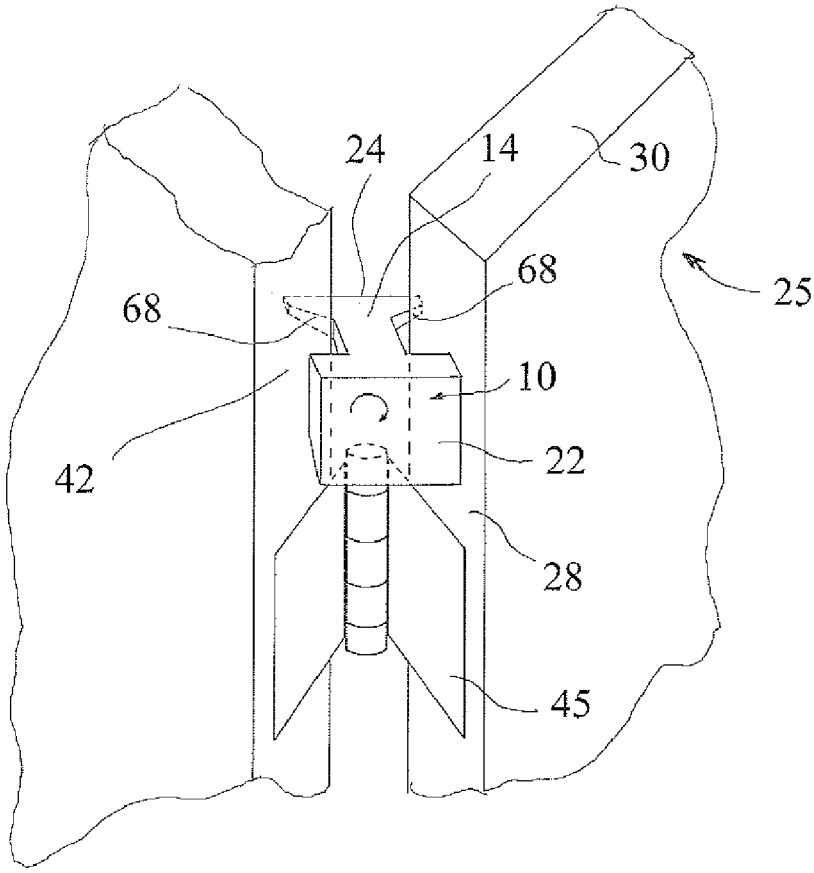
FIG. 6 is a perspective view of a method of using the wedge of the present invention on the inside edge of a door to secure it in an open position.
Figure 7:
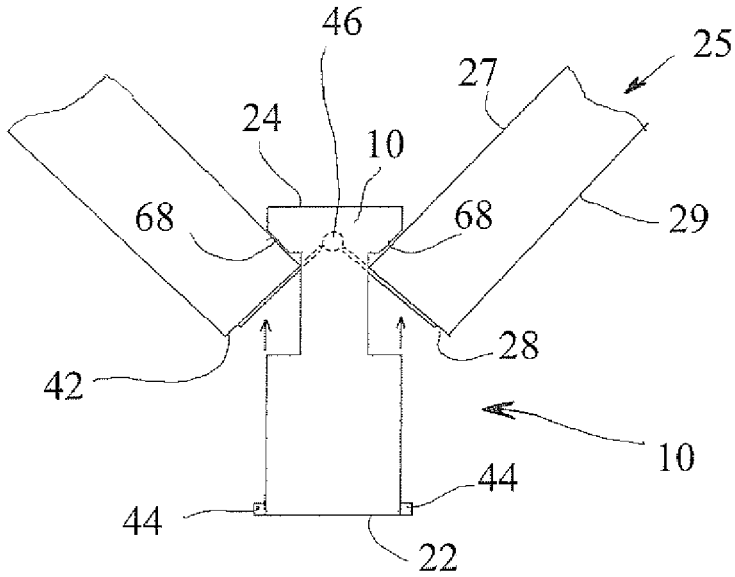
FIG. 7 is a top plan view of the method of using the wedge shown in FIG. 6.

FIGS. 6 and 7 show the method in which the wedge may be utilized in a securing position along the inside edge 28 of the door, between the door and door frame. By opening the door completely, to at least 90°, a space is created between the inside edge 28 and the door frame 26. Using the finger tabs 44 to firmly hold wedge 10, the short end 24 of the wedge is inserted in the space above hinge 45, with the top and bottom surfaces 14, 12 vertically aligned, and subsequently turned 90° as shown by the arrow in FIG. 6 to the position shown to hold the wedge in the space. As shown in FIG. 7, opposed angular surfaces 68 are in general alignment and preferably make at least partial contact with the rear face 27 of door 25 and the rear side of door frame 42, so that the side surface indentations partially engage the door inside edge and the door frame. If necessary, wedge 10 may be adjusted as shown by the arrows to make contact with the inside edge 28 of the door and the face of the door frame 42. In this position, wedge 10 imparts a separating force between the inside edge 28 of the door and the door frame 42 to maintain the door in the open position.

Figure 8:
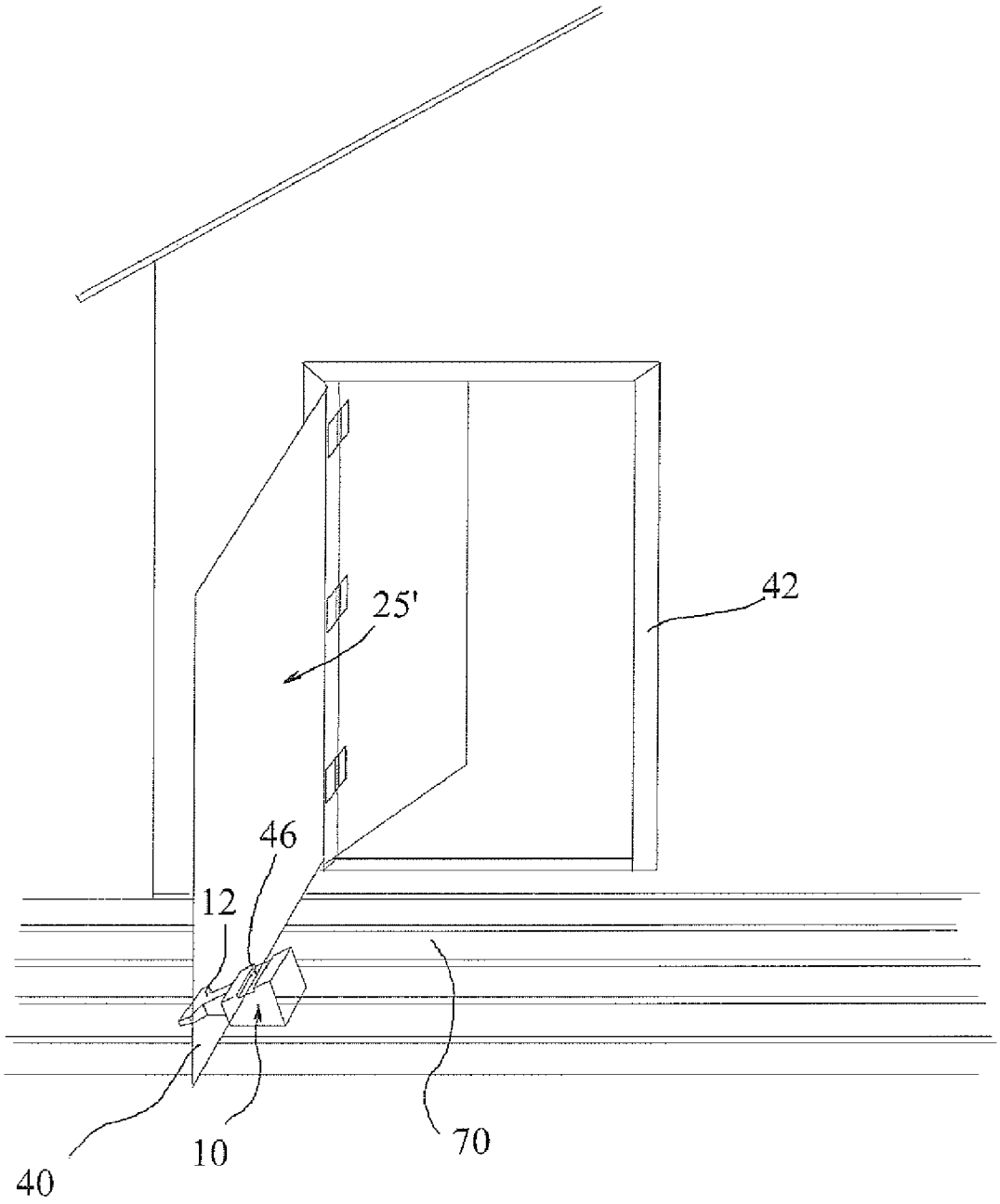
FIG. 8 is a perspective view of method of using the wedge of the present invention on the bottom edge of a door to secure it in an open position.

As shown in FIG. 8, when the wedge is flipped over from its position shown in FIG. 1 so that bottom surface 12 is facing upward, the bottom surface indentation 46 may function to meet the door bottom edge 40 and secure a screen door 25' when there is a gap between the bottom edge 40 and the outdoor ground 70. In the position shown, bottom surface indentation 46 is only partially engaged with the bottom edge 40 of the door 25, because the door bottom edge contacts only a portion of bottom support surface 48, and the door faces either do not contact at all, or contact only a portion of, opposite lip surfaces 50. Of course, wedge 10 may also serve as a conventional wedge in the position of FIG. 1, with its bottom surface 12 on ground 70 and top surface 14 contacting and holding the door bottom edge 40. The height of wedge 10 at the tall end 22 may be selected to be larger than that of a typical doorstop to better serve as a bottom edge doorstop when there is a large gap between the bottom edge 40 of a door and a ground surface 70 below the bottom edge when the door is in the open position.

The wedge of any of the embodiments described is preferably made from a molded polymeric material which is impact resistant and brightly colored. A luminescent dye may be coated on the surfaces of or incorporated into the polymeric material so that it may be seen even in low light levels or complete darkness for better visibility. The preferred coating or dye to be utilized in connection with the present invention is a fluorescent paint or ink that may or may not be normally visible in daylight, but is particularly visible with the use of an ultraviolet (UV) light source. In particular, a UV light source may be used to illuminate and fluoresce the wedge to mark its location in the door, and more importantly, mark the location of an exit from a room or building in the often dark and smoky conditions in a powerless building during a fire or other emergency.

In a preferred embodiment of the present invention, wedge 10 is supplied in a kit with a UV light source, such as a commercially available hand-held UV flashlight. For example, in FIG. 5, a UV light source 80 which emits ultra violet light rays 82 is shown illumination wedge 10 that is coated with a luminescent coating. During an emergency in low or no-light conditions, the firefighter or other emergency worker may shine UV light from flashlight 80 around a room and locate wedge 10, which is secured to a door leading to or from the room in which the firefighter is located to aid in ingress into or egress from the room or building. The visible luminescent wedge 10 then is able to guide the firefighter through the doorway that it is holding open.

Thus, the present invention provides a wedge that can be used during fires and other emergencies to secure the door open so that firefighters can work and move in and out of a structure without having to hold the door open. Also this wedge can prevent a door from closing on a fire hose, pinching off the supply of water or having a door lock behind the firefighter. It can also aid in the ventilation of fire gases and smoke. When made with a luminescent material, a UV light source can be used to locate the wedge and the exit to the room or building.

The wedge has several slots to accommodate different types of doors including engaging the top edge of a door or sliding in just above a hinge where the wedge will not get kicked out of the way. Because of the shape and design of the firefighters' wedge, it may also be used as a standard door stop at the bottom edge of the door. The wedge is sized so that it may be carried in a coat pocket and the tabs on the tall end of the wedge sides aid in gripping the wedge with the thumb and fingers for easier handling and use of the device.

The firefighters' wedge may also be sized to create and maintain a space between an automobile window and the automobile door frame where the space created will allow an object to be inserted into the compartment of the vehicle especially for the purpose of unlocking a locked door.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention,

What is claimed is:

1. A wedge for securing a hinged door having opposite faces and an edge between the faces comprising:

a bottom surface;

a top surface at an acute angle to the bottom surface;

a pair of opposite side surfaces extending between the top and bottom surfaces; and an indentation on at least one of the bottom or side surfaces sized to fully engage the door edge and make substantial contact with the door edge and the opposite faces, wherein the side surfaces each have an indentation near the short end of the wedge, the side surface indentation comprising a side support surface parallel with and indented from the side surface, a wide surface perpendicular to the side support surface extending from the side support surface to the side surface, a narrow surface opposite the wide surface perpendicular to the side support surface and extending a distance therefrom, and an angular surface extending from the narrow surface at an angle extending to the side surface, the side support surface, the wide surface, the narrow surface and the angular surface extending from the top surface to the bottom surface of the wedge.

2. The wedge of claim 1 wherein the bottom surface has an indentation sized to fully engage the door edge.

3. The wedge of claim 1 wherein at least one of the side surfaces has an indentation sized to fully engage the door edge.

4. The wedge of claim 1 wherein the bottom surface and each of the side surfaces have an indentation sized to fully engage the door edge.

5. The wedge of claim 1 wherein the indentation is on the bottom surface and is a rectangular indentation near a tall end of the wedge extending from one side surface to the opposite side surface.

6. The wedge of claim 1 wherein the indentation is on at least one side surface and is near a short end of the wedge extending from the top surface to the bottom surface.

7. The wedge of claim 1 wherein the wedge is luminescent.

8. The wedge of claim 1 further having a finger tab on each of the side surfaces near a tall end of the wedge.

9. A method of securing a door having opposite faces and an edge between the faces, the door being hinged to a door frame, comprising:

providing a wedge having a bottom surface, a top surface at an acute angle to the bottom surface, a pair of opposite side surfaces extending between the top and bottom surfaces, at least one of the side surfaces having an indentation sized to fully engage the door edge, and an indentation on at least one of the bottom or side surfaces sized to fully engage the door edge and make substantial contact with the door edge and the opposite faces; and fully engaging the door edge with the side surface indentation to make substantial contact with the door edge and the opposite faces and contacting the door frame with the wedge to secure the door in an open position.

10. The method of claim 9 wherein the bottom surface has an indentation sized to fully engage the door edge, and wherein the bottom surface indentation is fully engaged with the door edge and makes substantial contact with the door edge and the opposite faces, and including contacting the frame with the wedge to secure the door in an open position.

11. The method of claim 10 wherein the door edge is a top edge fully engaging the bottom surface indentation.

12. The method of claim 9 wherein the door edge is a top edge fully engaging the side surface indentation.

13. The method of claim 9 wherein the bottom surface has an indentation and wherein the bottom surface indentation partially engages the door edge to secure the door in an open position.

14. The method of claim 13 wherein the door edge is a bottom edge and wherein the bottom surface indentation partially engages with the door bottom edge.

15. A method of securing a door having opposite faces and an inside edge between the faces, the door being hinged to a door frame, comprising:

providing a wedge having a bottom surface, a top surface at an acute angle to the bottom surface, a pair of opposite side surfaces extending between the top and bottom surfaces, each of the side surfaces has an indentation sized to fully engage the door edge, and an indentation on at least one of the bottom or side surfaces sized to fully engage the door edge and make substantial contact with the door edge and the opposite faces; and partially engaging the inside door edge and a door frame edge with the side surface indentations to secure the door in an open position.

* * * * *